US008092612B2

(12) United States Patent
Mishima et al.

(10) Patent No.: US 8,092,612 B2
(45) Date of Patent: Jan. 10, 2012

(54) COOLING METHOD AND COOLING DEVICE

(75) Inventors: Keisuke Mishima, Tokyo (JP); Hirofumi Kuroda, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 614 days.

(21) Appl. No.: 11/887,450

(22) PCT Filed: Mar. 30, 2006

(86) PCT No.: PCT/JP2006/307268

§ 371 (c)(1), (2), (4) Date: Mar. 6, 2009

(87) PCT Pub. No.: WO2006/107089

PCT Pub. Date: Oct. 12, 2006

(65) Prior Publication Data

US 2009/0211731 A1 Aug. 27, 2009

(30) Foreign Application Priority Data

Mar. 31, 2005 (JP) ..... 2005-101844

(51) Int. Cl.
*B08B 7/04* (2006.01)
*B21D 41/00* (2006.01)

(52) U.S. Cl. ..... 134/19; 72/370.12; 72/453.01; 72/82; 72/96

(58) Field of Classification Search ..... 134/19, 134/42, 201; 72/82, 96, 370.12, 453.01; 219/216, 530, 469, 470, 471; 432/9, 10, 11

See application file for complete search history.

(56) References Cited

U.S. PATENT DOCUMENTS

| | | | | |
|---|---|---|---|---|
| 3,910,423 | A * | 10/1975 | Killian et al. | 414/591 |
| 4,203,721 | A * | 5/1980 | Hayes et al. | 432/10 |
| 2003/0154600 | A1 | 8/2003 | Umeda et al. | |

FOREIGN PATENT DOCUMENTS

| | | |
|---|---|---|
| JP | 60-210324 | 10/1985 |
| JP | 10-43815 | 2/1998 |
| JP | 2002-153930 | 5/2002 |
| JP | 2003-200241 | 7/2003 |
| JP | 2003-334626 | 11/2003 |

* cited by examiner

*Primary Examiner* — Michael Barr
*Assistant Examiner* — Saeed T Chaudhry
(74) *Attorney, Agent, or Firm* — Rabin & Berdo, PC

(57) ABSTRACT

A cooling device (70) for cooling a work piece (9) that has reached a high temperature due to the implementation of a closing operation in which a bottom portion (9*c*) is formed by closing an end portion of the tubular work piece (9) comprises a tilting mechanism (151) which tilts the work piece (9) such that the bottom portion (9*c*) faces downwards and a cooling water tank (155) storing cooling water. The bottom portion (9*c*) of the work piece (9) tilted by the tilting mechanism (151) is submerged in cooling water stored in the cooling water tank (155).

4 Claims, 4 Drawing Sheets

COOLING METHOD AND COOLING DEVICE

FIELD OF THE INVENTION

This invention relates to an improvement in a cooling method and a cooling device for cooling a work piece that has reached a high temperature due to a closing operation for closing an open end of a metal pipe material.

BACKGROUND OF THE INVENTION

In a closing method, a work piece constituted by a metal pipe material is rotated, and while heating the work piece, a die is pressed against the work piece such that the work piece gradually approaches the die and is subjected to plastic deformation.

A closing machine for performing this closing operation comprises an outer diameter chuck that grips an outer peripheral surface of the work piece, and a chuck spindle that drives the outer diameter chuck to rotate together with the work piece. The outer diameter chuck grips the work piece, which is introduced via a conveyor or the like, and drives the work piece to rotate in a predetermined position. The closing machine closes the work piece into a predetermined shape corresponding to the die by pressing the rotating die against the work piece that is rotated by the outer diameter chuck.

This closing method and closing machine are disclosed in JP2002-153930.

The work piece, which reaches a high temperature of 1000° C. or more upon implementation of the closing operation, is cooled by a cooling device and then press molded using a closing press-molding device.

A conventional cooling device cools the work piece by pouring cooling water over the work piece.

However, since the conventional cooling device cools the work piece by pouring cooling water over the work piece, it is difficult to cool the bottom portion of the work piece, which has reached a high temperature due to the closing operation, quickly and evenly, and as a result, the tact time required to cool a single work piece increases.

It is therefore an object of his invention to provide a cooling method and a cooling device with which the bottom portion of a work piece that has reached a high temperature due to a closing operation can be cooled quickly.

SUMMARY OF THE INVENTION

This invention provides a cooling method for cooling a work piece that has reached a high temperature due to the implementation of a closing operation in which a bottom portion is formed by closing an end portion of the tubular work piece, comprising tilting the work piece using a tilting mechanism such that the bottom portion faces downward, and submerging the bottom portion of the tilted work piece in cooling water stored in a cooling water tank.

Further, this invention provides a cooling device for cooling a work piece that has reached a high temperature due to the implementation of a closing operation in which a bottom portion is formed by closing an end portion of the tubular work piece, comprising a tilting mechanism which tilting the work piece such that the bottom portion faces downward, and a cooling water tank storing cooling water such that the bottom portion of the work piece tilted by the tilting mechanism is submerged in the cooling water stored in the cooling water tank.

According to this invention, the bottom portion of the work piece tilted by the tilting mechanism is submerged in the cooling water stored in the cooling water tank, and therefore the heat of the bottom portion of the work piece, which has reached a high temperature due to implementation of the closing operation, is radiated quickly and evenly to the cooling water. As a result, the tact time for cooling a single work piece can be shortened, enabling an improvement in production efficiency.

When the work piece is submerged in the cooling water, the work piece is tilted such that the bottom portion thereof faces downward, and therefore the open end of the work piece is not submerged in the cooling water. As a result, cooling water can be prevented from entering the inside of the work piece through the open end of the work piece.

BRIEF DESCRIPTION OF THE DRAWINGS

FIG. 4 is a sectional view of a conveyance device and so on.

DESCRIPTION OF THE PREFERRED EMBODIMENTS

This invention will now be described in detail, in accordance with the attached drawings.

Figure 1:
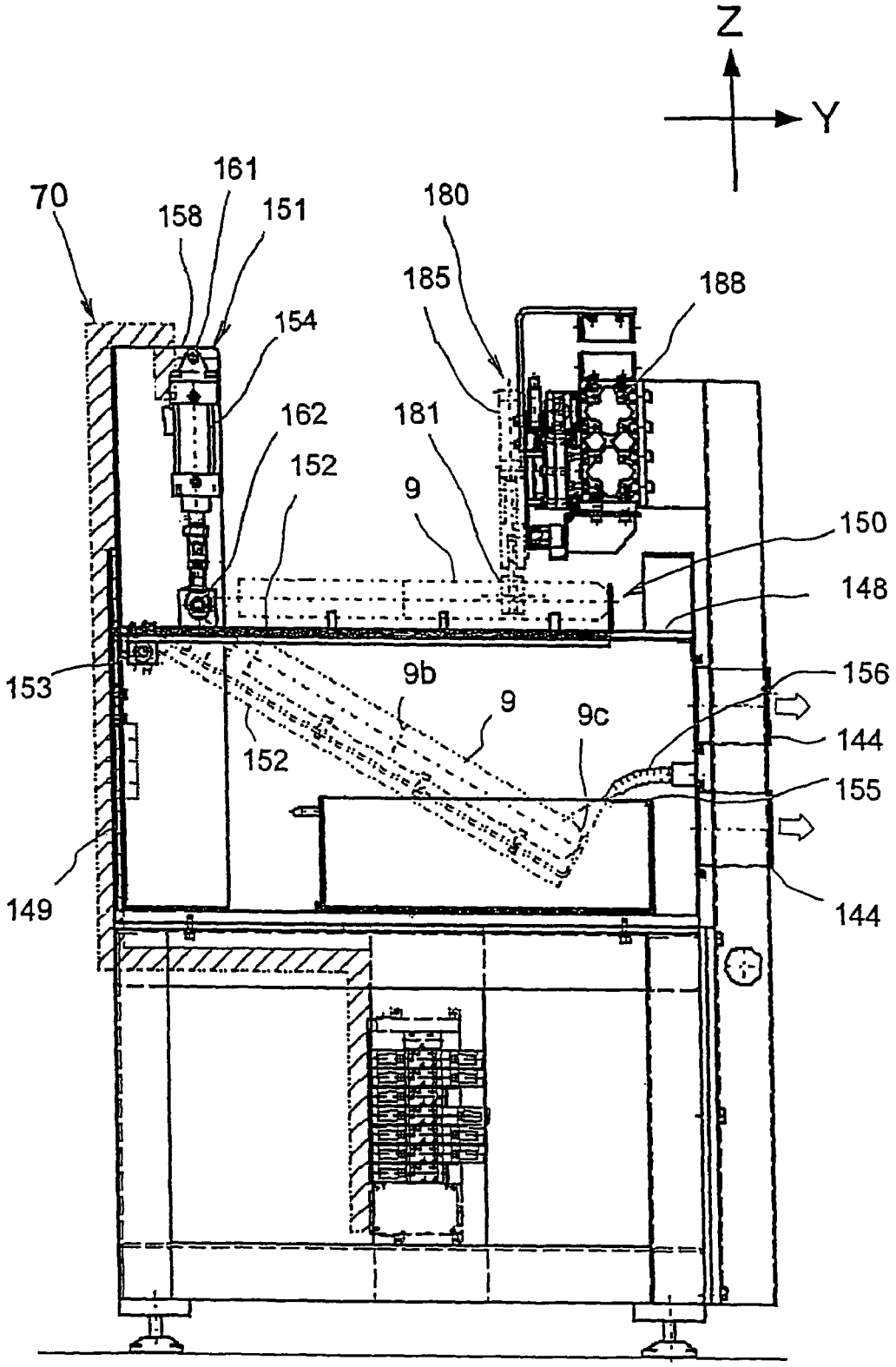
FIG. 1 is a sectional view of a cooling device, illustrating an embodiment of this invention.
Figure 2:
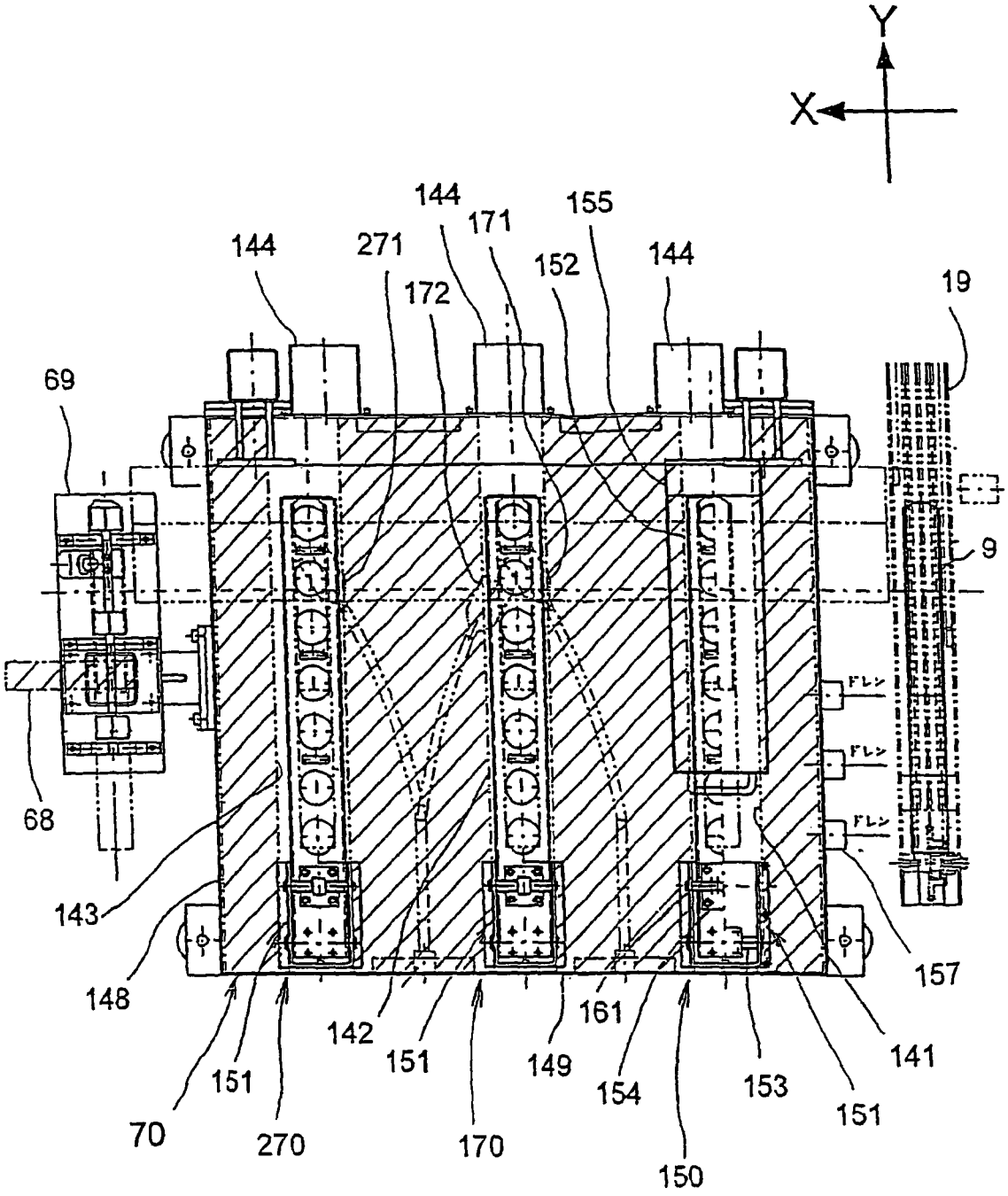
FIG. 2 is a plan view of the cooling device.
Figure 3:
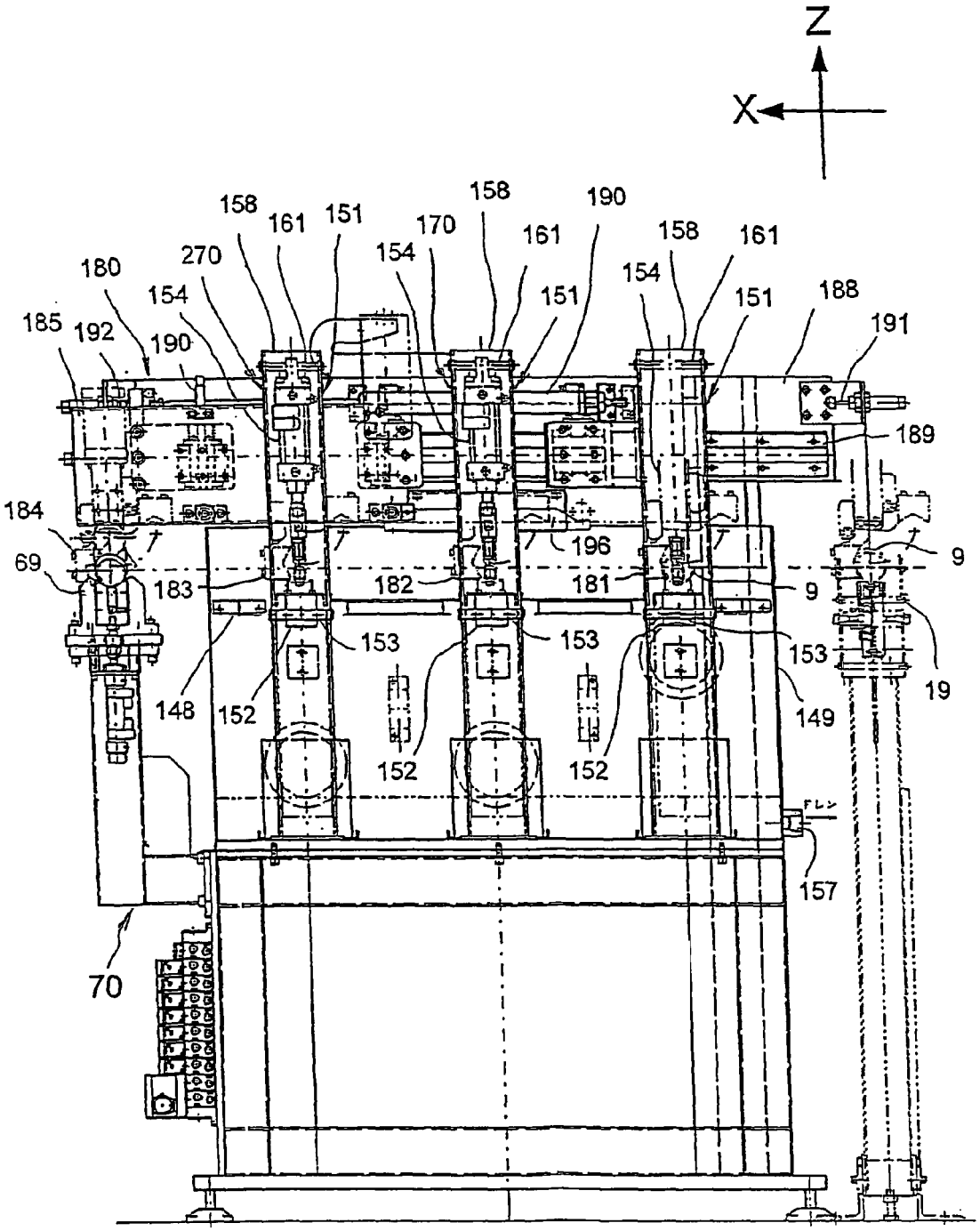
FIG. 3 is a front view of the cooling device.

FIGS. 1 to 3 show the overall constitution of a cooling device 70. In FIGS. 1 to 3, three axes, namely X, Y, and Z, are set orthogonal to each other, and it is assumed that the X axis extends in a substantially horizontal lateral direction, the Y axis extends in a substantially horizontal front-rear direction, and the Z axis extends in a substantially vertical direction.

The cooling device 70 cools a work piece 9 that has reached a high temperature following a cooling operation in which a bottom portion 9*c* is formed on the work piece 9 by closing an open end of the tubular work piece 9.

A closing machine, not shown in the figure, is provided in front of the cooling device 70 in the Y axis direction. The closing machine causes the work piece 9, which is constituted by a metal pipe material, to rotate, and presses a die against the work piece 9 while heating the work piece 9 such that a tip end portion of the work piece 9 gradually approaches the die and is subjected to plastic deformation, thereby forming a completely closed bottom portion 9*c*.

The work piece 9, which reaches a high temperature of 1000° C. or more following a closing operation performed by the closing machine, is conveyed rearward in the Y axis direction by a conveyor 19 and halted at a side portion of the cooling device 70. The work piece 9 is taken up from the conveyor 19 by a conveyance device 180, and cooled by the cooling device 70 while being moved in the X axis direction. Following cooling, the work piece 9 is conveyed to a discharge table 69 from the cooling device 70, and when placed on the discharge table 69, the work piece 9 is conveyed to a closing press-molding device, not shown in the figure, via a chuck 68, and press-molded by the closing press-molding device.

In FIG. 2, the cooling device 70 is provided with a single water cooling device 150 and two air blowing devices 170, 270, which are arranged in the X axis direction. As the work piece 9 is moved in the X axis direction by the cooling device 70, first the work piece 9 is submerged in cooling water by the water cooling device 150, and then the water on the work piece 9 is blown away by the air blowing devices 170, 270.

As shown in FIG. 1, the water cooling device 150 comprises a tilting mechanism 151 that tilts the work piece 9 relative to the horizon, and a cooling water tank 155 storing the cooling water in which the tilted work piece 9 is submerged. Thus, the bottom portion 9*c* of the work piece 9 tilted by the tilting mechanism 151 is submerged in the cooling water stored in the cooling water tank 155.

The tilting mechanism 151 comprises a tilting table 152 which is supported so as to be capable of rotating relative to a main body 149 of the cooling device 70 about the horizontal axis via a pin 153, and an air cylinder 154 which rotates the tilting table 152 via the pin 153.

A post 158 is provided in an upright position in the main body 149 of the cooling device 70, and a base end portion of the tilting table 152 is connected rotatably to the post 158 via the pin 153.

A cylinder base end portion of the air cylinder 154 is connected rotatably to an upper portion of the post 158 via a pin 161, and a rod tip end portion of the air cylinder 154 is connected rotatably to a midway point on the tilting table 152 via a pin 162.

As shown by the solid line in FIG. 1, when the air cylinder 154 performs a contraction operation, the tilting table 152 is set in a horizontal position. As shown by the dot-dot-dash line in FIG. 1, when the air cylinder 154 performs an expansion operation, the tilting table 152 tilts such that the bottom portion 9*c* of the work piece 9 placed on the tilting table 152 is submerged in the cooling water stored in the cooling water tank 155.

The tilting table 152 supports the work piece 9 in a predetermined position such that even when the tilting table 152 tilts, the position of the work piece 9 does not shift.

The cooling water tank 155 takes the form of a square box with an open upper portion. Cooling water supplied from a water discharge pipe 156 is stored in the cooling water tank 155.

The water discharge pipe 156 communicates with a water supply via piping not shown in the figure. The water discharge pipe 156 supplies cooling water towards the bottom portion 9*c* of the tilted work piece 9 in the cooling water tank 155.

The cooling water that overflows from the cooling water tank 155 flows out into the main body 149, and is discharged to the outside via piping not shown in the figure through three drainage ports 157 that open onto the main body 149.

It should be noted that the constitution by which cooling water is supplied to the cooling water tank 155 is not limited to that described above, and a structure in which the cooling water circulates through the cooling water tank 155 may be provided. In this case, a filter for filtering the cooling water may be inserted into the circulation path of the cooling water to purify the cooling water, and a heat exchanger or the like for cooling the cooling water may be inserted into the circulation path of the cooling water to keep the temperature of the cooling water supplied to the cooling water tank 155 constant.

The cooling water tank 155 is disposed in a predetermined position of the main body 149, and may be removed from the main body 149 during cleaning or the like.

Each air blowing device 170, 270 comprises a tilting mechanism 151 that tilts the work piece 9 relative to the horizon, and air blowholes 171, 172, 271 that blow air onto the tilted work piece 9.

Similarly to the water cooling device 150 described above, the tilting mechanism 151 of each air blowing device 170, 270 comprises a tilting table 152 that is supported so as to be capable of rotating about the horizontal axis relative to the main body 149 of the cooling device 70 via a pin 153, and an air cylinder 154 that rotates the tilting table 152 via the pin 153.

The air blowholes 171, 172 are provided so as to face either side of the tilted work piece 9 that is placed on the tilting table 152 of the air blowing device 170. The air blowhole 271 is provided so as to face one side of the tilted work piece 9 that is placed on the tilting table 152 of the air blowing device 270.

The air blowholes 171, 172, 271 communicate with a high-pressure air supply source via an air pipe not shown in the figure, and blow pressurized air toward the tilted work piece 9.

A cover 148 is provided on the main body 149 of the cooling device 70 so as to cover an upper open portion thereof. Three in/outlets 141 to 143 are formed in series in the cover 148. The work piece 9 that is tilted by the tilting mechanism 151 of the water cooling device 150 passes through the in/outlet 141, and the work pieces 9 that are tilted by the tilting mechanism 151 of the air blowing devices 170, 270 pass respectively through the in/outlets 142, 143.

The main body 149 of the cooling device 70 is provided with six ducts 144 that are arranged in two vertical columns and open onto a side wall portion thereof. Each duct 144 blows air into the main body 149 via a fan, not shown in the figure, to discharge water vapor generated in the main body 149 forcibly to the outside.

The conveyance device 180 comprises four chucks 181 to 184 that grip the work piece 9, and four air cylinders 185 that drive the respective chucks 181 to 184 to open and close. The conveyance device 180 moves the chucks 181 to 184 in the X axis direction and the Z axis direction, thereby opening and closing the respective chucks 181 to 184, and by repeating this operation, four work pieces 9 are conveyed simultaneously.

The chuck 181 furthest to the right side of FIG. 3 conveys the work piece 9 on the conveyor 19 to the tilting table 152 of the water cooling device 150. The second chuck 182 from the right side of FIG. 3 conveys the work piece 9 on the tilting table 152 of the water cooling device 150 to the tilting table 152 of the air blowing device 170. The third chuck 183 from the right side of FIG. 3 conveys the work piece 9 on the tilting table 152 of the air blowing device 170 to the tilting table 152 of the air blowing device 270. The chuck 184 furthest to the left side of FIG. 3 conveys the work piece 9 on the tilting table 152 of the air blowing device 270 to the discharge table 69. The work piece 9 placed on the discharge table 69 is conveyed to the closing press-molding device, not shown in the figure, via the chuck 68.

Figure 4:
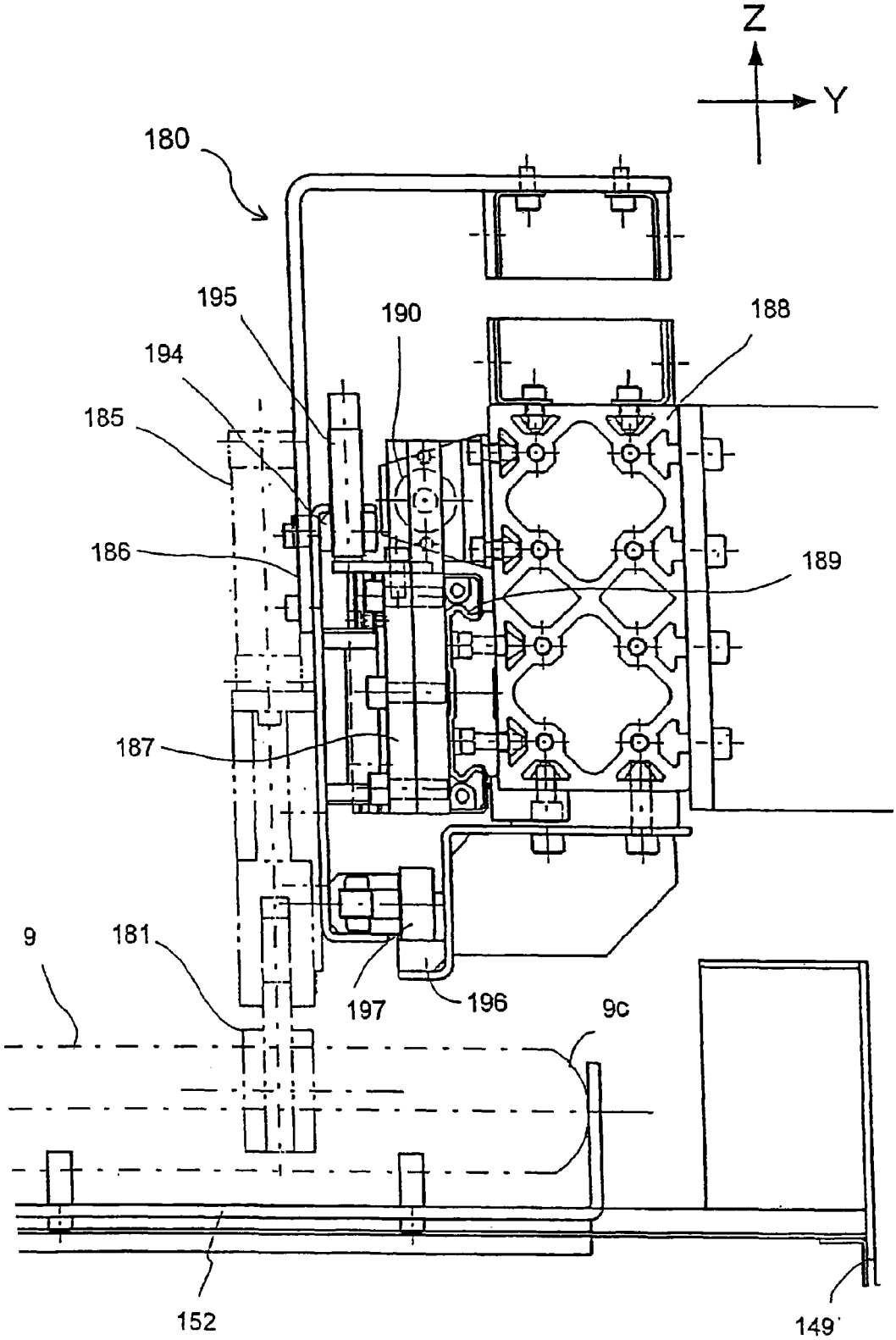

As shown in FIG. 4, the conveyance device 180 comprises a chuck support table 186 for supporting the chucks 181 to 184, a guide rod 195 for supporting the chuck support table 186 elevatably in the Z axis direction relative to a sliding table 187, a cam 196 for raising and lowering the chuck support table 186 in the Z axis direction as the sliding table 187 reciprocates in the X axis direction, a guide rail 189 that supports the sliding table 187 movably in the X axis direction relative to a pedestal 188, and an air cylinder 190 for causing the sliding table 187 to reciprocate in the X axis direction.

The guide rod 195 stands upright from the sliding table 187 in the Z axis direction. The chuck support table 186 is supported elevatably in the Z axis direction via a bush 194 that is fitted into the guide rod 195 slidably.

The cam 196 is fixed to the pedestal 188. The chuck support table 186 is raised and lowered in the Z axis direction via a roller 197 that contacts the cam 196 rotatably.

The pedestal 188 is provided with left and right dampers 191, 192 on which the sliding table 187 impinges. When the sliding table 187 moves in the X axis direction and stops, the left and right dampers 191, 192 contract, thereby alleviating the impact.

The cooling device 70 is constituted as described above. The work piece 9, which reaches a high temperature of 1000° C. or more following a closing operation performed by the closing machine, is conveyed to a side portion of the cooling device 70 by the conveyor 19, introduced into the cooling device 70, and cooled to approximately 100° C. by the cooling device 70.

The cooling device 70 cools the work piece 9 by performing the following processes in sequence.

The chuck 181 of the conveyance device 180 picks up the work piece 9 on the conveyor 19, moves in the X axis direction while rising and falling, and places the work piece 9 on the tilting table 152 of the water cooling device 150.

In the water cooling device 150, the air cylinder 154 of the tilting mechanism 151 expands such that the tilting table 152 is rotated downward about the horizontal axis via the pin 153, and as a result, the bottom portion 9*c* of the work piece 9 placed on the tilting table 152 is tilted downward.

Thus, the entire surface of the bottom portion 9*c*, which is the part of the work piece 9 that reaches the highest temperature, is submerged in the cooling water stored in the cooling water tank 155 and cooled quickly and evenly through heat radiation to the cooling water.

In the water cooling device 150, the air cylinder 154 of the tilting mechanism 151 then contracts such that the tilting table 152 rotates upward about the horizontal axis via the pin 153, and as a result, the work piece 9 placed on the tilting table 152 is returned to a horizontal position.

The chuck 182 of the conveyance device 180 picks up the work piece 9 on the tilting table 152 of the water cooling device 150, moves in the X axis direction while rising and falling, and places the work piece 9 on the tilting table 152 of the air blowing device 170.

In the air blowing device 170, the air cylinder 154 of the tilting mechanism 151 expands such that the tilting table 152 rotates downward about the horizontal axis via the pin 153, and as a result, the bottom portion 9*c* of the work piece 9 placed on the tilting table 152 is tilted downward.

Thus, air blown through the air blowholes 171, 172 impinges on both sides of the bottom portion 9*c* of the work piece 9 such that the water on the bottom portion 9*c* is blown away. At this time, the work piece 9 radiates heat to the blown air as well as the cooling water thereon, and as a result, the work piece 9 is cooled further.

In the air blowing device 170, the air cylinder 154 of the tilting mechanism 151 then contracts such that the tilting table 152 rotates upward about the horizontal axis via the pin 153, and as a result, the work piece 9 placed on the tilting table 152 is returned to a horizontal position.

The chuck 182 of the conveyance device 180 picks up the work piece 9 on the tilting table 152 of the air blowing device 170, moves in the X axis direction while rising and falling, and places the work piece 9 on the tilting table 152 of the air blowing device 270.

In the air blowing device 270, the air cylinder 154 of the tilting mechanism 151 expands such that the tilting table 152 rotates downward about the horizontal axis via the pin 153, and as a result, the bottom portion 9*c* of the work piece 9 placed on the tilting table 152 is tilted downward.

Thus, air blown through the air blowhole 271 impinges on one side of the bottom portion 9*c* of the work piece 9 such that the water on the bottom portion 9*c* is blown away. At this time, the work piece 9 radiates heat to the water and the blown air, and as a result, the work piece 9 is cooled further.

In the air blowing device 270, the air cylinder 154 of the tilting mechanism 151 then contracts such that the tilting table 152 rotates upward about the horizontal axis via the pin 153, and as a result, the work piece 9 placed on the tilting table 152 is returned to a horizontal position.

The chuck 182 of the conveyance device 180 picks up the work piece 9 on the tilting table 152 of the air blowing device 270, moves in the X axis direction while rising and falling, and places the work piece 9 on the discharge table 69.

As described above, the cooling device 70 is constituted such that the bottom portion 9*c* of the work piece 9 tilted by the tilting mechanism 151 is submerged in the cooling water stored in the cooling water tank 155, and therefore, the heat of the bottom portion 9*c*, which reaches the highest temperature of all parts of the work piece 9 upon implementation of the closing operation, is radiated to the cooling water quickly and evenly. As a result, the tact time for cooling a single work piece 9 is shortened, enabling an improvement in production efficiency.

Having been cooled by the cooling device 70, each work piece 9 is press-molded by the closing press-molding device. By making the temperature of each of the work pieces 9 cooled by the cooling device 70 even, the occurrence of irregularities in the shape of each work piece 9 press-molded by the closing press-molding device can be suppressed.

When the work piece 9 is submerged in the cooling water, the work piece 9 is tilted such that the bottom portion 9*c* thereof faces downward, and therefore an open end 9*b* positioned at the upper portion of the tilted work piece 9 is not submerged in the cooling water. Hence, cooling water is prevented from entering the inside of the work piece 9 through the open end 9*b*.

By having the air blowing device 170 blow air onto the work piece 9 tilted by the tilting mechanism 151, the water on the work piece 9 is blown away quickly, and as a result, the tact time for dewatering a single work piece 9 is shortened, enabling an improvement in production efficiency.

Air is blown onto the work piece 9 diagonally downward in accordance with the downward tilt of the bottom portion 9*c* of the work piece 9, and therefore the water on the work piece 9 can be prevented from entering the inside of the work piece 9 through the open end 9*b* of the work piece 9.

The cooling device 70 comprises the two air blowing devices 170, 270 such that air is blown onto a single work piece 9 twice. In so doing, the work piece 9 can be dewatered sufficiently even when the work piece 9 has cooled to room temperature after a certain amount of time has elapsed following the closing operation.

It should be noted that this invention is not limited to this constitution, and the cooling device 70 may comprise a single air blowing device 170.

The conveyance device 180 moves the four chucks 181 to 184 in synchronization with each other so that the processing of each of the processes described above can be performed in parallel on three work pieces 9. As a result, the tact time required to cool a single work piece 9 can be shortened to approximately 7 seconds, for example.

The conveyance device 180 comprises the chuck support table 186 for supporting the chucks 181 to 184, the sliding table 187, which reciprocates in the X axis direction, and the cam 196 for raising and lowering the chuck support table 186 in the Z axis direction as the sliding table 187 reciprocates in the X axis direction, and therefore, each work piece 9 can be conveyed by having the single air cylinder 190 cause the sliding table 187 to reciprocate in the X axis direction such that the chucks 181 to 184 move in synchronization with each other while rising and falling. Hence, the number of actuators required to move the chucks 181 to 184 can be reduced, enabling structural simplification and an increase in the compactness of the device.

INDUSTRIAL APPLICABILITY

As described above, the cooling method and cooling device according to this invention can be used to cool a work piece that has reached a high temperature due to the implementation of a closing operation for closing an open end thereof.

The invention claimed is:

1. A cooling method for cooling a work piece that has reached a high temperature due to the implementation of a closing operation in which a bottom portion is formed by closing an end portion of the tubular work piece, comprising:

tilting the work piece such that the bottom portion faces downward and submerges in a cooling water tank storing cooling water;

blowing air onto another work piece; and moving a plurality of chucks for gripping a plurality of the work pieces in synchronization with each other such that submerging a work piece in the cooling water and blowing air onto another work piece are performed in parallel.

2. A cooling device for cooling a work piece that has reached a high temperature due to the implementation of a closing operation in which a bottom portion is formed by closing an end portion of the tubular work piece, comprising:

a tilting mechanism which tilts the work piece such that the bottom portion faces downward;

a cooling water tank storing cooling water such that the bottom portion of the work piece tilted by the tilting mechanism is submerged in the cooling water stored in the cooling water tank;

an air blowing device which blows air onto the work piece; and a conveyance device which moves a plurality of chucks for gripping a plurality of the work pieces in synchronization with each other such that submerging the work piece in the cooling water and blowing air onto another workpiece are performed in parallel.

3. The cooling device as defined in claim 2, wherein:

the air blowing device which blows air onto the work piece is tilted by the tilting mechanism.

4. The cooling device as defined in claim 2, wherein the conveyance device comprises:

a chuck support table which supports the chucks;

a sliding table which reciprocates in a substantially horizontal direction; and a cam which raises and lowers the chuck support table relative to the sliding table, and is configured to convey each of the work pieces by having the chucks move in synchronization with each other while rising and falling.

* * * * *